United States Patent [19]

Dennison

[11] Patent Number: 4,943,805

[45] Date of Patent: Jul. 24, 1990

[54] CONDUIT-ENCLOSED INDUCTION LOOP FOR A VEHICLE DETECTOR

[76] Inventor: James L. Dennison, 213 Tait Ave., Los Gatos, Calif. 95030

[21] Appl. No.: 930,726

[22] Filed: Nov. 13, 1986

[51] Int. Cl.[5] ..... G08G 1/01

[52] U.S. Cl. ..... 340/933; 285/121; 340/941

[58] Field of Search ..... 340/933, 935, 939, 941; 180/167; 404/9, 11, 71, 72, 75; 285/115, 121, 156, 96

[56] References Cited

U.S. PATENT DOCUMENTS

| | | | |
|---|---|---|---|
| 1,709,212 | 4/1929 | Green . | |
| 2,144,535 | 1/1939 | Horni . | |
| 2,149,998 | 3/1937 | Jones . | |
| 2,199,573 | 5/1940 | Paul . | |
| 2,201,146 | 5/1940 | Barker . | |
| 2,212,986 | 8/1940 | Horni . | |
| 2,441,554 | 5/1948 | Barker . | |
| 2,450,166 | 9/1948 | Rich | 340/941 |
| 3,105,221 | 9/1963 | Schwarz . | |
| 3,346,842 | 10/1967 | Dixon . | |
| 3,457,547 | 7/1969 | Gray . | |
| 3,458,802 | 7/1969 | Koerner . | |
| 4,001,745 | 1/1977 | Goodman . | |
| 4,239,415 | 12/1980 | Blikken | 340/941 |
| 4,315,242 | 2/1982 | Lueg et al. . | |
| 4,449,115 | 5/1984 | Koerner . | |
| 4,508,371 | 4/1985 | Maier | 285/121 |
| 4,676,532 | 6/1987 | Gronau et al. | 285/156 |

FOREIGN PATENT DOCUMENTS

| | | | |
|---|---|---|---|
| 0284281 | 5/1966 | Australia | 285/121 |
| 0028397 | of 1909 | United Kingdom | 285/121 |

OTHER PUBLICATIONS

*IMSA Journal,* Mar.-Apr. 1982, The Art of Detection—A System Concept, by George E. Palm—3M Company, 4 pages.

Inductive Loop Vehicle Detectors, by Tom Potter, from *IMSA Journal,* pp. 10-14, Mar.-Apr. 1982.

*Traffic Detector Handbook,* by U.S. Dept. of Transportation, Federal Highway Administration, all pages through 173, Jan. 1985.

"Inductive Loops", Equipment Development & Test Report No. 7700-9, Aug. 1977, Loren DeLand, U.S. Dept. of Agriculture.

*Primary Examiner*—Joseph A. Orsino

*Assistant Examiner*—Brent A. Swarthout

*Attorney, Agent, or Firm*—Flehr, Hohbach, Test, Albritton & Herbert

[57] ABSTRACT

An induction loop and a method of making an induction loop having conduit sections connected by a coupling assembly. The coupling assembly includes a passageway-defining body having ends for receiving sections of conduit. An intermediate body portion includes an opening exposing an intermediate passageway exteriorly. A lid for sealingly covering the opening includes an extension placeable into the opening for mating engagement with corresponding wall portions of the coupling body. The body and lid provide lateral external-pressure-withstanding structure to prevent damage to the assembled loop by absorbing regional pressures. This structure also provides for internal-pressure-withstanding sealing between the two so that, after completion of insertion of conductor in the conduit loop, the conduit may be injected under increased pressure with a heated rubberized asphalt sealant which is flexible at ambient conditions. Flexible joints in the form of short flexible conduit portions are inserted between the coupling body and the relatively rigid conduit section to permit angular displacement of the body relative to the section.

14 Claims, 2 Drawing Sheets

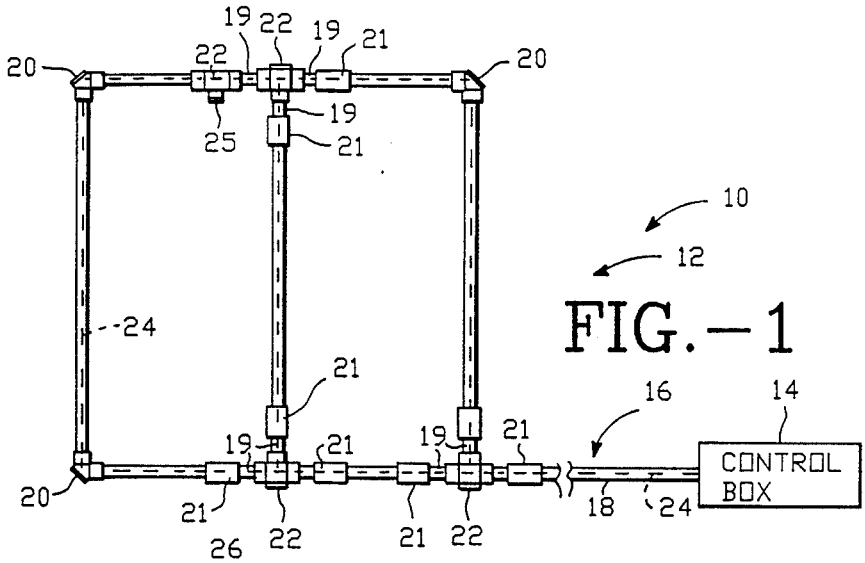
FIG.—1
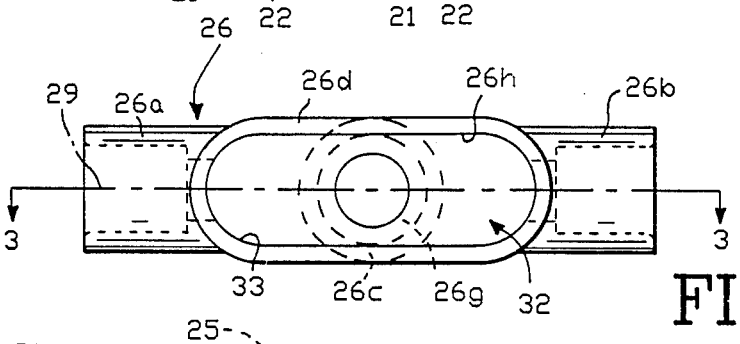
FIG.—2
FIG.—3
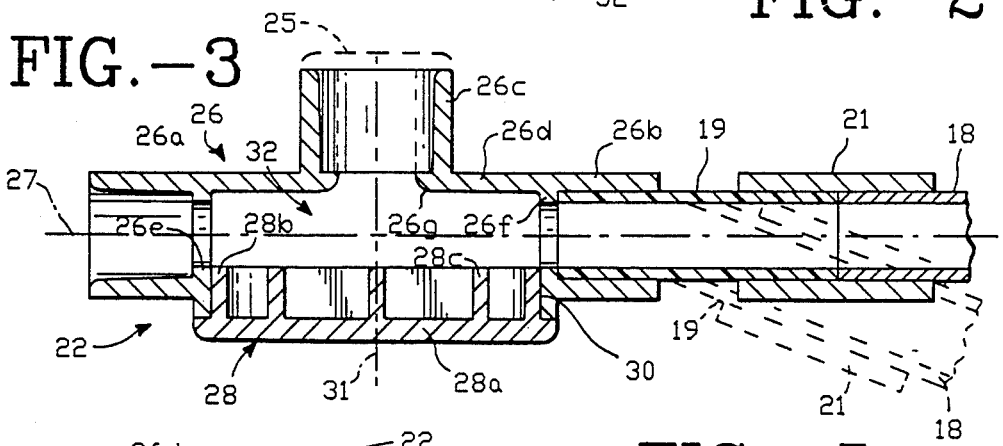
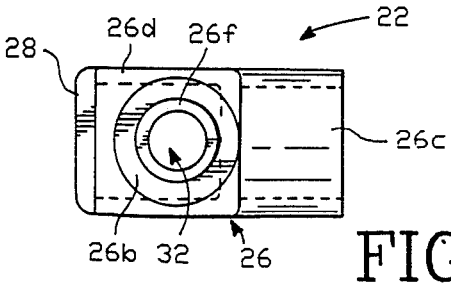
FIG.—4
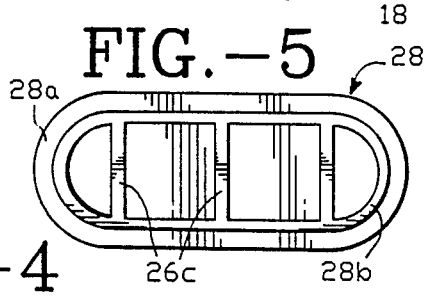
FIG.—5

CONDUIT-ENCLOSED INDUCTION LOOP FOR A VEHICLE DETECTOR

BACKGROUND OF THE INVENTION

This invention relates to induction loop vehicle detectors, and in particular to such detectors in which the induction loop conductors are supported in a conduit having pressure-withstanding couplings.

The need to detect, count, monitor or control vehicles on highways, bridges, parking lots, garages, street intersections, and shopping centers is well established. The primary use of such devices is the control of vehicles at intersections with traffic lights. That is, turn lanes and cross traffic can be controlled on an as needed basis with the use of built-in traffic monitoring devices. In most common use today are inductive loop detectors wherein a generally horizontal loop, or a plurality of loops, of a conductor are placed in the traffic lane and connected to control equipment. By applying current to the conductor, inductance is generated which is altered by the presence of a vehicle.

Conventionally, most loops are installed by cutting or sawing a one-eighth inch to three-eighths of an inch wide by a one inch to three inch deep saw cut in the pavement The resulting channel typically is filled with epoxy, rubber, plastic, wax, or asphalt based compounds after the conductor is laid in it. Such methods have not been found to be entirely acceptable because the failure rate is fairly high. Failure results when the channel filler separates from the channel walls allowing moisture to enter, or the abrading and ultimate breaking or shorting of conductors at the channel corners of the saw cuts. This can also be due to deterioration in the pavement adjacent the saw cut, or to vibration caused by road equipment and heavy traffic near or adjacent the slot.

Durability of the loop can be improved by placing the conductors in a groove in a base layer of asphalt or concrete which is then overlayed with a top layer to seal the conductors. However, ultimately, it is found that similar types of failures result due to pavement movement and deterioration and vibration of the conductors in the asphalt for the reasons previously mentioned.

SUMMARY OF THE INVENTION

The present invention overcomes these problems by installing the loop conductors in conduit which has a heavy-duty coupling assembly designed to withstand the stresses of the environment to which the inductive loop is subjected. The assembly is sufficiently strong to withstand substantial internal pressures, thereby allowing the injection of a sealant or filler into the conduit loop which encapsulates the conductor and thereby isolates it from the environment surrounding the conduit loop.

These advantages are obtained in a coupling assembly having a body defining a passageway to the ends of which conduit sections are attachable An intermediate section of the passageway communicates with an opening in the side of the coupling to provide access to the conductors during installation. The intermediate section of the coupling body is vertically at least as thick as the balance of the body so that regional pressures are applied primarily to that section rather than to the more vulnerable conduit sections The intermediate section and lid are also reinforced with what are effectively vertical braces so that greater forces may be withstood. The coupling body and lid are structured to matingly seat against each other so that they may be adhered together to form a pressure-withstanding and moisture sealing connection.

The present invention also provides flexible joint means for connecting a coupling body to a conduit section. This joint means permits relative angular displacement of the conduit section relative to the coupling body. This invention also provides for filling the conduit loop with a filler which is of a substantially non-flowing consistency at ambient conditions and of a relatively freeflowing consistency at a predetermined temperature and pressure greater than corresponding ambient temperatures and pressures. These and other features and advantages of the present invention will be more clearly understood from a consideration of the drawings and the following detailed description of the preferred embodiments.

BRIEF DESCRIPTION OF THE DRAWINGS

FIG. 1 is a simplified diagram showing an induction loop detector made according to the present invention and useable for practicing the method of the invention;

FIG. 2 is a side elevational view of a "T" coupling unit body as included in the detector of FIG. 1;

FIG. 3 is a cross-sectional view of the coupling unit body of FIG. 2 taken along line 3—3 with a lid installed on it and a flexible joint attached to it;

FIG. 4 is an end view of the coupling unit body shown in FIG. 2 with the lid installed on the coupling body;

FIG. 5 is an inside elevational view of the lid shown in FIGS. 3 and 4;

DETAILED DESCRIPTION OF THE PREFERRED EMBODIMENT

Figure 6:
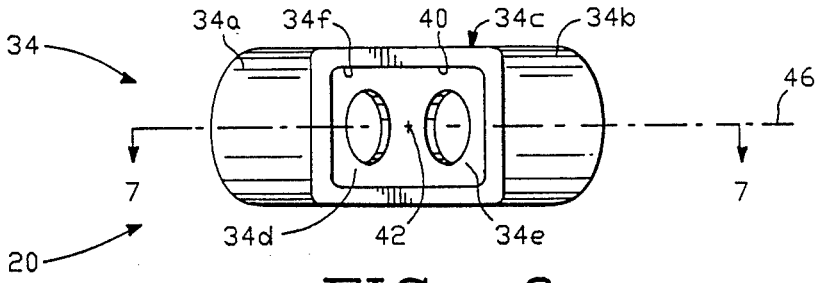
FIG. 6 is an outside elevational view of a body of an elbow coupling unit as shown in FIG. 1 taken from the outside corner of the elbow coupling unit.

Referring initially to FIG. 1, an induction loop detector made according to the present invention and useable for practicing the method of the invention is shown generally at 10. Detector 10 includes an induction loop assembly 12 connected to a detector control unit 14 through a connecting run 16. Loop assembly 12 and connecting run 16 both include conduit sections 18, flexible conduit portions 19, connecting 90° elbow coupling units 20, straight connectors or coupling units 21, T-coupling units 22 and electrical conductor 24. The conduit sections and coupling units are preferably made of Schedule 80 PVC or CPVC or equivalent. Conduit portions 19 are preferably made of PVC-HW or similar material which is substantially more flexible than Schedule 80 PVC but has the same inside and outside diameters such as that made by TIP Sales of Simi Valley, Calif., having material No. WS90A. The size of conductor 24 is selected to be sufficient for the particular application.

In a traffic-monitoring application, loop assembly 12 would typically be approximately six feet wide by six feet or more long. The assembly is divided into two equal portions with each side forming separate loops. In a typical situation, each side may have two or three loops of conductors. This would mean that the center leg of the loop would have four or six conductors. Therefore, the outside conduit sections might be ½ inch (inner diameter) conduit with the center leg being ¾ inch conduit.

In this preferred embodiment, after conductor 24 is positioned in the conduit and prior to installation with connecting run 16, a suitable filler is preferably injected into the conduit loop. This is done by applying the filler through T-coupling unit 22'. It is injected into the conduit until the fluid begins to flow out of the T-coupling unit to which the connecting run conduit section is attached Representative fillers or sealants commonly used for open channels include epoxies, resins and wax.

However, in accordance with the preferred method of practicing the invention, a hot-melt sealant sold by Crafco for use in sealing open groove detector loops or a similar compound is used as the conduit filler. This is a rubberized asphalt sealant which softens at 180° F. and is fully melted between 200° F. and 240° F. It is preferably injected at a much higher temperature, such as at 400° F. Such injection is also preferably performed at a pressure of approximately 500 p.s.i. to make sure that the hot fluid travels quickly enough to fill the conduit before it cools to ambient conditions and stiffens. It remains flexible and tacky at ambient conditions but does not observably flow in the conduit.

When the conduit is filled with sealant, a cap 25 is fastened by adhesive over the filler opening of coupling unit 22', as shown in FIG. 1 and in phantom in FIG. 3.

The Crafco sealant is found to be a particularly advantageous sealant in that it specifically adheres to the conductor and conduit walls, thereby assuring that the conductor stays moisture-free, even when the conduit cracks. Epoxy is found to be less preferable because it tends to become brittle. At road surface ambient temperatures this rubberized asphalt sealant remains flexible or resilient. The roadway, conduit, sealant and conductors expand and contract at different rates with changes in ambient temperatures. Further, vibrations due to traffic movement causes relative movement of the conductor and sealant. A stiff sealant, such as epoxy, stresses the conductors. This results in reduced lifespan and changes in the resistivity of the conductor which in turn produces erroneous vehicle detection signals. These problems are overcome by a resilient sealant since the conductor is able to move relative to the sealant with a minimal amount of tension or stress.

It will be appreciated that the substantial pressure used during sealant injection creates substantial internal pressure on the conduit and fixtures. Conventional plumbing and electrical coupling units have been used but are found to be ineffective because they do not provide a seal, and are found to not be capable of withstanding the pressure required by this system. Also, PVC is found to soften and become more flexible when heated by the sealant, but it does not deform if the loop is maintained on a support or frame until it cools.

Loop assembly 12 as shown in FIG. 1 is of a configuration most preferably used for inserting in existing roadways. In such cases, the asphalt is cut to have approximately a two to four inch deep by two to four inch wide channel conforming to the loop. The cutting of the existing roadways results in substantially right-angle corners. This is the reason for having elbow coupling units 20. However, if the assembly is to be installed as part of new roadway construction, the loop assembly can be pressed down into fresh concrete or asphalt and then smoothed over. Alternatively, the preformed loop can be fastened into position or formed up several inches above the base rock. The new asphalt then can be laid around the loop frame in a manner similar to thick concrete around rebar. In such applications, the sharp corners are not required. The elbow coupling units may then be replaced with simple conduit bends.

It will be appreciated from the above discussion that the loop of the present invention is subjected to a very harsh environment. First, the conduit and couplings are subject to very high pressures during injection of the sealant Finally, once installed in a roadway, it is subject to high external pressures from roadway traffic and vibrations. The couplings of the present invention are built to provide very secure junctions for joining sections of conduit Typically, such junctions, not being integral with the conduit sections, are the most likely to fail. These problems are overcome with the couplings made according to the present invention.

Describing initially the construction of the T-coupling units 22 reference is made particularly to FIGS. 2–5. Coupling unit 22 includes a body 26 and a lid 28 which are sealingly secured together (after installation of conductors 24) using a typical plastic conduit sealant adhesive 30. Body 26 is formed to define a passageway 32 to extend between opposite conduit receptacles **26*a*, 26*b*. Receptacle 26*b* is shown in FIG. 3 joined with joint means including a flexible conduit portion 19. As shown, and as indicated previously, portion 19 has internal and external diameters which are substantially the same as conduit sections 18. This assures that the same coupling units and receptacles may be used for both of them. Conduit portion 19 is relatively more easily flexed as compared to conduit 18. It has been found, that during installation, as vehicles drive over loop assembly 12 after it has been placed on a surface during installation, the various conduit sections are subjected to a substantial amount of lateral pressure which causes them to bend relative to the associated coupling units. If conduit sections 18 were installed directly into the coupling units, they would suffer stress cracks at the edges of the coupling units. This is prevented by the existence of flexible conduit portions 19**.

As shown in phantom lines in FIG. 3, the conduit sections readily bend about the flexible conduit portions to permit angular transverse movement of the conduit portions relative to the coupling unit body. The exposed length of conduit portion is preferably adequate to allow the adjacent conduit section to pivot transversely relative to the coupling body 26 by an angle of approximately 30 degrees. This is found to allow sufficient movement to accomodate the pressures applied to the various loop parts during installation.

Because the conduit portions are subjected to lateral pressures, it is preferable that the exposed distance between coupling body 26 and straight coupling unit 21 be restricted. Although not shown to scale in FIGS. 1 and 3 it is preferable that approximately a three-inch length of a one-half or three-quarter inch I.D. conduit portion be provided. Accounting for the length of the conduit portion which is inserted into the respective receptacles of the respective coupling units, approximately one-half inch to three-quarters of an inch of the conduit portion remains exposed between the two corresponding coupling units. The adjacent ends of the two coupling units thus support the weights and resulting stresses which are applied directly to the region associated with the conduit portion and do not result in the conduit portion being laterally deformed It is preferable that the exposed length of conduit portion should not exceed approximately two times its outer diameter in order to avoid subjecting it to possibly damaging external forces.

Further, in part because of the limited distance between the associated coupling units, the flexible conduit portion is able to withstand the substantial pressures applied internally during injection of the heated sealant.

It will be appreciated that other forms of providing a flexible joint between the conduit sections and coupling units may be provided. However, if the loop assembly is to be installed in a preformed groove so that it is not subjected to direct contact by vehicles during installation, the flexible joints are not required.

Referring again to body 26, a third conduit receptacle 26c (also defining part of passageway 32) is positioned normal to the run 27 of the passageway connecting receptacles 26a, 26b. This is the receptacle of T-coupling unit 22' shown in FIG. 1 which cap 25, shown in phantom lines, seals after sealant is inserted into the loop Passageway 32 can be seen to be disposed about a plane 29 as represented by the plane of view of FIG. 3 or by line 29 in FIG. 2. Intermediate the three receptacles is an intermediate section 26d which serves to provide access to cables or conductors during stringing in the conduit sections.

Serving as a boundary between intermediate section 26d and the three receptacles are abutments 26e, 26f, 26g as shown These abutments extend into the passageway to constrict it, as shown particularly in FIG. 4, to a diameter substantially equal to the inside diameter of the associated conduit section 18.

As shown in FIG. 2, intermediate section 26d has substantially flat top and bottom surfaces and rounded end surfaces so that it has the shape of an oval when viewed as shown in FIG. 2. The intermediate section has a wall portion 26h which extends perpendicular to the plane of FIG. 2 and parallel with an axis 31. Wall portion 26h defines an oval opening 33 exposing exteriorly passageway 32 to the exterior. The portions of intermediate section 26d extending between receptacle 26c and receptacles 26a and 26b are generally planar and vertical. Further, it can be seen in the view of FIG. 2 that the vertical width of intermediate section 26d is greater than the corresponding width of receptacles 26a and 26b, but substantially equal to the corresponding width of receptacle 26c.

Referring now to FIGS. 3–5 in particular, lid 28 includes a generally planar cover portion 28a which has a thickness in the vertical direction as shown in FIGS. 4 and 5 substantially equal to the thickness of intermediate section 26d and which is disposed normal to axis 31 and perpendicular to passageway opening 33. Further, the lid includes a generally oval shaped extension or skirt 28b which is sized for frictional, sliding receipt within wall portion 26h. Both the wall portion and skirt are continuous in the oval shape so that a complete seal can be made when they are adhered together. Extending vertically and integrally with the top and bottom sections of skirt 28b, as shown in FIG. 5, are three brace portions 28c. These brace portions, as well as the skirt extend just long enough into body intermediate section 26d to avoid obstructing passageway 32 as defined by the bores in abutments 26e, 26f. This prevents interference with conductors extending along the passageway while providing the maximum vertical support by the individual brace portions.

With lid 28 adhered to body 26, a very rigid intermediate portion of coupling 22 exists. More specifically, rigid vertical support is provided by the back wall of intermediate portion 26d between receptacles 26b and 26c, as well as the vertical parts of wall portion 26h, lid cover portion 28a and lid brace portions 28c. Because the lid and intermediate portion are at least as wide vertically as the largest receptacle (receptacle 26c), vertical forces applied to coupling unit 22 are going to be applied primarily on the intermediate section 26d. These forces are restrained by the support portions just described. The receptacles are therefore subject to less destructive forces Further, the adhesive 30 holding the lid skirt and associated wall portion together is able to withstand the internal pressures applied during injection of the loop assembly while maintaining a sealed connection. It will be appreciated that this construction does not provide a door which can later be opened for access to the internal conductors as is provided by conventional electrical couplings. It is intended to be installed once and have a substantial maintenance-free life in a hostile environment Referring now to FIGS. 6–8, elbow coupling unit 20 is illustrated. This unit, similar to the T-coupling unit, includes a coupling body 34 and a coupling lid 36 which is attached after conductor installation to the body by an adhesive 38. Body 34 includes a pair of receptacles 34a, 34b disposed to receive conduit sections 18 at relative 90° angles. Connecting the receptacles is an intermediate section 34c which is separated from the receptacles by abutments 34d, 34e, respectively. Intermediate section 34c includes a continuous wall portion 34f defining an opening 40. Wall portion 34f is disposed to be continuous and parallel with an axis 42 which is transverse to a passageway 44 providing communication between receptacles 34a and 34b.

Figure 7:
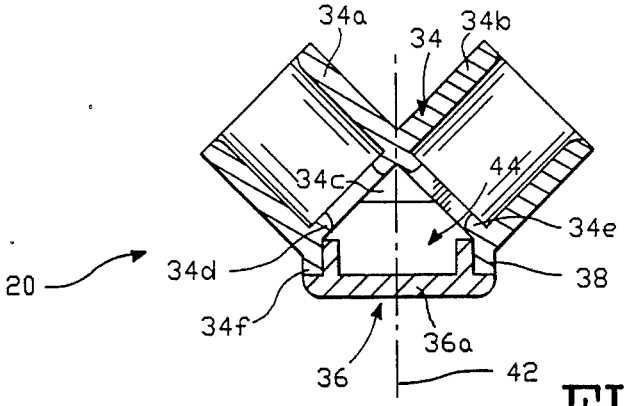
FIG. 7 is a cross-sectional view of the elbow coupling unit body of FIG. 6 taken along line 7—7 with the addition of a lid installed on the coupling body.

Door 36 includes a cover portion 36a which is perpendicular to a plane containing, generally, passageway 44, as identified particularly in FIG. 6 as plane 46. The lid also includes a skirt 36b sized for mating and friction sliding receipt in wall portion 34f so that when adhesive 38 is applied between the skirt and wall portions an effective seal is formed.

Figure 8:
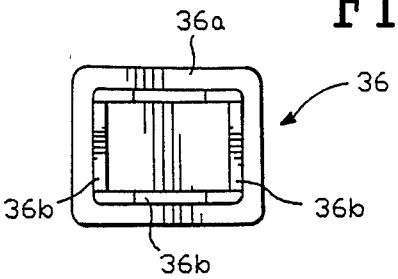
FIG. 8 is an inside elevational view of the lid shown in FIG. 7.

It will be noted that the top and bottom of intermediate section 34c are generally planar, coparallel with plane 46, and are generally in a triangle shape. Lid 36 has a generally rectangular shape as viewed along axis 42, particularly as shown in FIG. 8. The two side vertical sections of the skirt thus provide vertical support members when inserted within opening 40. Skirt 36b is seen to include a further extension on the top and bottom portions which extend above and below passageway 44 to provide increased surface area for attachment with the corresponding wall portions 34f.

As with the intermediate section of T-coupling unit 22, elbow coupling unit 20 provides for effective vertical support. In particular, the vertical walls of intermediate section 34c and vertical portions of abutments 34d, 34e are able to withstand substantial vertical pressure. Also, since they have a vertical width which is as high as the corresponding thickness of receptacles 34a, 34b, they receive most of the vertical pressure applied in the region of the elbow coupling unit. This reduces the amount of pressure applied to the coupling/conduit joint at the receptacles. Further, lid 36 has a substantially planar vertical cover portion 36a and side vertical portions of skirt 36b all of which contribute to provide additional vertical support.

With opening 40 facing sideways of passageway 44, access is provided for feeding conductor into and out of conduit sections associated with the two receptacles. Also, the top of the intermediate section is an integral part of the coupling body so that vertical pressures do not directly affect the junction between lid 36 and body 34.

It will be appreciated by those skilled in the art that other configurations of an induction loop detector may be made with a loop assembly conforming with the present invention. In particular, coupling units made according to the invention may also be made in other forms than those shown. Although the invention has been particularly shown and described with reference to the foregoing preferred embodiments, it will be understood by those skilled in the art that other changes in form and detail may be made therein without departing from the spirit and scope of the invention as defined in the claims.

What we claim is:

1. In an inductive loop vehicle detector having a conductor extending in a loop-shaped conduit:

a conductor-surrounding filler within said conduit; and a conduit coupling assembly joining sections of the conduit comprising:

a body defining (a) a passageway extending through said body sized to receive at each end of said passageway an end of a section of conduit, and (b) an opening externally exposing a portion of said passageway intermediate its ends, said opening being defined by a wall portion extending continuously about said opening; and a lid sized to completely cover said opening and having a continuous loop-forming extension matingly engaging said continuous wall portion when said lid is covering said opening; and said continuous extension and wall portion being mutually adherable for sealing said opening;

said conductor-surrounding filler filling said coupling assembly; and an adhesive adhering said continuous extension and said wall portion together.

2. A coupling assembly according to claim 1 wherein said body is sized to receive an end of a conduit section having a predetermined internal diameter in each of said passageway ends, said body further having a conduit abutment extending into and constricting said passageway adjacent each of said passageway ends, and having substantially the same internal diameter as that of the conduit section.

3. In an inductive loop vehicle detector having a conductor extending in a loop-shaped conduit filled with a conductor-surrounding filler, a conduit coupling assembly for joining sections of the conduit comprising:

a body defining a passageway extending through said body and sized to receive at each end of said passageway an end of a section of conduit, and an opening externally exposing a portion of said passageway intermediate its ends, said opening being defined by a wall portion extending continuously about said opening; and a lid sized to completely cover said opening and having a continuous loop-forming extension structured to matingly engage said continuous wall portion when said lid is covering said opening;

said continuous extension and wall portion being mutually adherable for sealing said opening;

wherein said body is sized to receive an end of a conduit section having a predetermined internal diameter in each of said passageway ends, said body further having a conduit abutment extending into and constricting said passageway adjacent each of said passageway ends, and having substantially the same internal diameter as that of the conduit section;

wherein said abutment extends within a plane generally perpendicular to the plane of said passageway, and said continuous wall portion and extension include a stretch disposed in planes perpendicular to the plane of said passageway;

wherein said wall portion stretch which is perpendicular to the plane of said passageway is integral with one of said abutments.

4. In an inductive loop vehicle detector having a conductor extending in a loop-shaped conduit filled with a conductor-surrounding filler, a conduit coupling assembly for joining sections of the conduit comprising:

a body defining a passageway extending through said body and sized to receive at each end of said passageway an end of a section of conduit, and an opening externally exposing a portion of said passageway intermediate its ends, said opening being defined by a wall portion extending continuously about said opening; and a lid sized to completely cover said opening and having a continuous loop-forming extension structured to matingly engage said continuous wall portion when said lid is covering said opening;

said continuous extension and wall portion being mutually adherable for sealing said opening; and a flexible joint means connecting one or more of said conduit sections and an associated body for permitting relative transverse angular displacement between said conduit section and said associated body.

5. A coupling assembly according to claim 4 wherein said joint means includes a predetermined length of resilient conduit having one end attached to a corresponding one of said ends of said passageway of said associated coupling body, and a connector for joining the other end of said length of resilient conduit with the corresponding end of said conduit section, said length of resilient conduit being more flexible than said associated conduit section.

6. A coupling assembly according to claim 5 said length of resilient conduit has a predetermined maximum transverse cross-sectional dimension and the portion of the length of said resilient conduit extending between said associated body and said conduit section is less than twice said predetermined transverse cross-sectional dimension.

7. A coupling assembly according to claim 5 wherein said portion of said length of resilient conduit extending between said associated body and said conduit section is capable of withstanding an internal pressure of at least 200 p.s.i.

8. An inductive loop vehicle detector comprising:

conduit means extending in a predetermined loop placeable in the bed of a roadway over which vehicles travel, including at least two conduit sections extending along predetermined stretches of said conduit means loop, and a conduit coupling for joining corresponding ends of said conduit sections comprising a body defining a passageway extending through said body and having ends sized to receive an end of a section of conduit;

flexible joint means coupling said conduit coupling and said one of said conduit sections for permitting relative transverse angular displacement between said conduit section and said coupling;

conductor means extending in said loopshaped conduit; and control means spaced from said loop and coupled to said conductor for energizing said conductor for sensing vehicles passing thereover.

9. An inductive loop vehicle detector according to claim 8 wherein said flexible joint means includes a predetermined length of resilient conduit having one end attached to a corresponding one of said ends of said coupling body passageway, and a connector joining the other end of said length of resilient conduit to the corresponding end of said associated conduit section, said length of resilient conduit being more flexible than said associated conduit section

10. A coupling assembly according to claim 9 wherein said resilient conduit has a predetermined maximum transverse cross-sectional dimension and the portion of the length of said resilient conduit extending between said coupling body and said connector is less than twice the distance of said predetermined maximum transverse dimension.

11. A method of constructing an inductive loop for a vehicle detector comprising:

assembling a continuous loop of conduit having conduit couplings connecting conduit sections, which couplings and sections are capable of withstanding a predetermined temperature and pressure greater than ambient temperature and pressure, said assembling step including mounting said couplings between conduit sections, at least one of said couplings having a cover receiving opening placing electrical conductors in the conduit loop to produce an electrical conductor loop, said placing step including using said cover receiving opening to thread an electrical conductor in said conduit loop;

heating a filler which is of a substantially non-flowing consistency when disposed in the conduit loop at ambient temperatures and pressures and is of a flowing consistency when disposed in the conduit loop at the predetermined temperature and pressure;

after said placing, sealing the cover receiving openings of each of said couplings having the same, by attaching a cover matingly to said cover receiving opening with adhesive and joining the respective mating surfaces of the coupling and cover;

filling the conduit loop with the heated filler at the predetermined pressure after said sealing step; and reducing the temperature and pressure of the filler within the loop toward ambient conditions.

12. A method according to claim 11 wherein the conduit sections have a predetermined longitudinal flexibility, said assembling step including inserting between a conduit section and an associated coupling a flexible joint means permitting relative transverse angular displacement between the conduit section and coupling.

13. A method according to claim 12 wherein said heating includes heating a filler which remains flexible at ambient temperatures for allowing conductors disposed in the conductor loop to move relative to the filler and conduit loop.

14. A method according to claim 13 wherein said heating includes heating a filler which is a rubberized asphalt sealant.

* * * * *